US006622644B2

(12) United States Patent
Buono

(10) Patent No.: US 6,622,644 B2
(45) Date of Patent: Sep. 23, 2003

(54) COLLAPSIBLE TABLE

(75) Inventor: Steven A. Buono, Greeneville, TN (US)

(73) Assignee: Maxchief Investment Limited (TW)

( * ) Notice: Subject to any disclaimer, the term of this patent is extended or adjusted under 35 U.S.C. 154(b) by 43 days.

(21) Appl. No.: 10/021,140

(22) Filed: Dec. 12, 2001

(65) Prior Publication Data

US 2003/0106474 A1 Jun. 12, 2003

(51) Int. Cl.[7] ..... A47B 3/00
(52) U.S. Cl. ..... 108/132
(58) Field of Search ..... 108/132, 131, 108/130, 129, 133; 248/188.6

(56) References Cited

U.S. PATENT DOCUMENTS

| | | | | |
|---|---|---|---|---|
| 159,227 | A | | 1/1875 | Sinclair |
| 236,197 | A | | 1/1881 | Valley |
| 1,487,497 | A | | 3/1924 | Whewell |
| 1,757,260 | A | | 5/1930 | Silverman |
| 1,956,946 | A | | 5/1934 | Duffy |
| 2,278,810 | A | | 4/1942 | Virtue et al. |
| 2,474,450 | A | | 6/1949 | Woodruff |
| 2,939,516 | A | | 6/1960 | Drew |
| 3,072,451 | A | | 1/1963 | Greenberg et al. |
| 3,357,729 | A | | 12/1967 | Krueger |
| 3,777,675 | A | * | 12/1973 | Hanusiak ..... 108/132 |
| 4,658,735 | A | | 4/1987 | Holton |
| 4,951,576 | A | | 8/1990 | Cobos et al. |
| D350,862 | S | | 9/1994 | Beller |
| 5,357,872 | A | * | 10/1994 | Wilmore ..... 108/35 |
| 5,638,761 | A | * | 6/1997 | Berkowitz et al. ..... 108/132 |
| 5,865,128 | A | | 2/1999 | Tarnay |
| D414,626 | S | | 10/1999 | Collins et al. |
| 5,984,047 | A | | 11/1999 | Rogers |
| D419,332 | S | | 1/2000 | Collins et al. |
| 6,112,674 | A | | 9/2000 | Stanford |
| 6,422,157 | B2 | * | 7/2002 | Rumph ..... 108/132 |
| 6,431,092 | B1 | | 8/2002 | Stanford |
| 6,471,173 | B1 | * | 10/2002 | Tseng ..... 248/439 |
| 6,530,331 | B2 | * | 3/2003 | Stanford ..... 108/132 |

OTHER PUBLICATIONS

IGLOO It's for Keeps, The Most Lightweight, Durable, Versatile Table You'll Every Carry. (US).

* cited by examiner

*Primary Examiner*—Jose V. Chen
(74) *Attorney, Agent, or Firm*—Luedeka, Neely & Graham, P.C.

(57) ABSTRACT

A collapsible table has a table top, such as may be formed by blow molding, with a substantially planar top surface and a bottom surface opposite the top surface. Formed into the bottom surface of the table top are opposing first and second channels. Disposed within the first channel is a first pivot bar, and disposed within the second channel is a second pivot bar. The table includes opposing first and second frame members secured to the bottom surface of the table top. Disposed between and pivotally attached to the first and second frame members are opposing first and second leg assemblies which are movable between a use position and a storage position. To maintain the first leg assembly in the use position, the table has a first support assembly including a first brace structure and a first support bar. The first brace structure has a first central pivotal attachment point, and one or more first distal pivotal attachment points attached to the first leg assembly. The first support bar has a first end which is pivotally attached to the first pivot bar and a second end which pivotally attached to the first central pivotal attachment point of the first brace structure. To maintain the second leg assembly in the use position, the table has a second support assembly having a second brace structure and a second support bar. The second brace structure has a second central pivotal attachment point, and one or more second distal pivotal attachment points attached to the second leg assembly. The second support bar has a first end which is pivotally attached to the second pivot bar and a second end which pivotally attached to the second central pivotal attachment point of the first brace structure.

25 Claims, 9 Drawing Sheets

COLLAPSIBLE TABLE

FIELD

This invention relates to collapsible furniture. More particularly, the invention relates to a lightweight table having legs which may collapse from a use position to a storage position.

BACKGROUND

Collapsible or foldable tables are widely used to provide temporary table space in multipurpose meeting rooms, such as banquet halls and hotel conference rooms. Collapsible tables are popular for such applications because they may be folded into a relatively flat package which provides for ease of storage between uses.

Prior collapsible table designs have been lacking for numerous reasons. Some tables, such as those having table tops made of solid wood or particle board, are extremely heavy and unwieldy, causing difficulty in transport and setup. Such heavy tables can also cause severe damage or injury if dropped during transport. Lighter-weight table designs generally employ support structures that become unstable when a significant amount of weight is placed on the table top. To overcome stability problems, some table designs employ folding support mechanisms that are complicated and costly to manufacture.

What is needed, therefore, is a folding table which is sturdy, relatively light-weight, and relatively inexpensive to manufacture.

SUMMARY

The above and other needs are met by a collapsible table having a table top, such as may be formed by blow molding, with a substantially planar top surface and a bottom surface opposite the top surface. Formed into the bottom surface of the table top are opposing first and second channels. Disposed within the first channel is a first pivot bar, and disposed within the second channel is a second pivot bar. The table includes opposing first and second frame members secured to the bottom surface of the table top. Disposed between and pivotally attached to the first and second frame members are opposing first and second leg assemblies which are movable between a use position and a storage position. To maintain the first leg assembly in the use position, the table has a first support assembly which includes a first brace structure and a first support bar. The first brace structure has a first central pivotal attachment point, and one or more first distal pivotal attachment points attached to the first leg assembly. The first support bar has a first end which is pivotally attached to the first pivot bar and a second end which is pivotally attached to the first central pivotal attachment point of the first brace structure. To maintain the second leg assembly in the use position, the table has a second support assembly which includes a second brace structure and a second support bar. The second brace structure has a second central pivotal attachment point, and one or more second distal pivotal attachment points attached to the second leg assembly. The second support bar has a first end which is pivotally attached to the second pivot bar and a second end which is pivotally attached to the second central pivotal attachment point of the first brace structure.

In a most preferred embodiment, the first and second pivot bars comprise substantially cylindrical rods, and the first and second channels each have a channel surface with an inside diameter substantially equivalent to the outside diameter of the first and second pivot bars.

Also in preferred embodiments, the bottom surface of the table top has opposing first and second projections separated by a separation distance. The first channel preferably has a first channel portion formed in the first projection, and a second channel portion formed in the second projection opposite the first channel portion. The first pivot bar is disposed within the first and second channel portions of the first channel, and spans the separation distance between the first and second projections. The second channel preferably has a third channel portion formed in the first projection, and a fourth channel portion formed in the second projection opposite the third channel portion. The second pivot bar is disposed within the third and fourth channel portions of the second channel, and spans the separation distance between the first and second projections.

In another aspect, the invention provides a method for manufacturing a collapsible table. The method includes forming a table top having a substantially planar top surface, a bottom surface opposite the top surface, and opposing first and second channels in the bottom surface. The method includes securing opposing first and second frame members to the bottom surface of the table top, and pivotally attaching first and second leg assemblies to the first and second frame members, such that the first and second leg assemblies are movable between a use position and a storage position.

According to the preferred method, a first brace structure is provided, having a first central pivotal attachment point and at least one first distal pivotal attachment point. The first distal pivotal attachment point of the first brace structure is pivotally attached to the first leg assembly. The method includes providing a first support bar having first and second ends. The second end of the first support bar is pivotally attached to the first central pivotal attachment point of the first brace structure. The method further includes providing a first pivot bar, pivotally attaching the first end of the first support bar to the first pivot bar, and inserting the first pivot bar into the first channel in the bottom surface of the table top.

A second brace structure is provided, having a second central pivotal attachment point and at least one second distal pivotal attachment point. The second distal pivotal attachment point of the second brace structure is pivotally attached to the second leg assembly. The method includes providing a second support bar having first and second ends. The second end of the second support bar is pivotally attached to the second central pivotal attachment point of the second brace structure. The method further includes providing a second pivot bar, pivotally attaching the first end of the second support bar to the second pivot bar; and inserting the second pivot bar into the second channel in the bottom surface of the table top.

BRIEF DESCRIPTION OF THE DRAWINGS

Further advantages of the invention are apparent by reference to the detailed description when considered in conjunction with the figures, which are not to scale so as to more clearly show the details wherein like reference numbers indicate like elements throughout the several views, and wherein.

DETAILED DESCRIPTION

Referring now to FIGS. 1–4, there is generally depicted a collapsible table 10 according to a preferred embodiment of the present invention. The table 10 includes a table top section 12 having a substantially planar top surface 12*a* and an opposing bottom surface 12*b*. In the preferred embodiment, the table top 12 is formed from a thermoplastic material by a molding process, such as blow molding. This process provides a sturdy, yet lightweight table top 12 that is well suited for applications where ease of handling and transport are important. Though thermoplastic is the preferred material for the table top 12, one skilled in the art will appreciate that the table top 12 could be formed of other materials, such as fiberglass or other composite materials, wood, or metal. Thus, the scope of the invention is not limited to any particular material or forming method for the table top 12. In a preferred embodiment, the table top 12 is about 48 inches long and about 24 inches wide.

Figure 1:
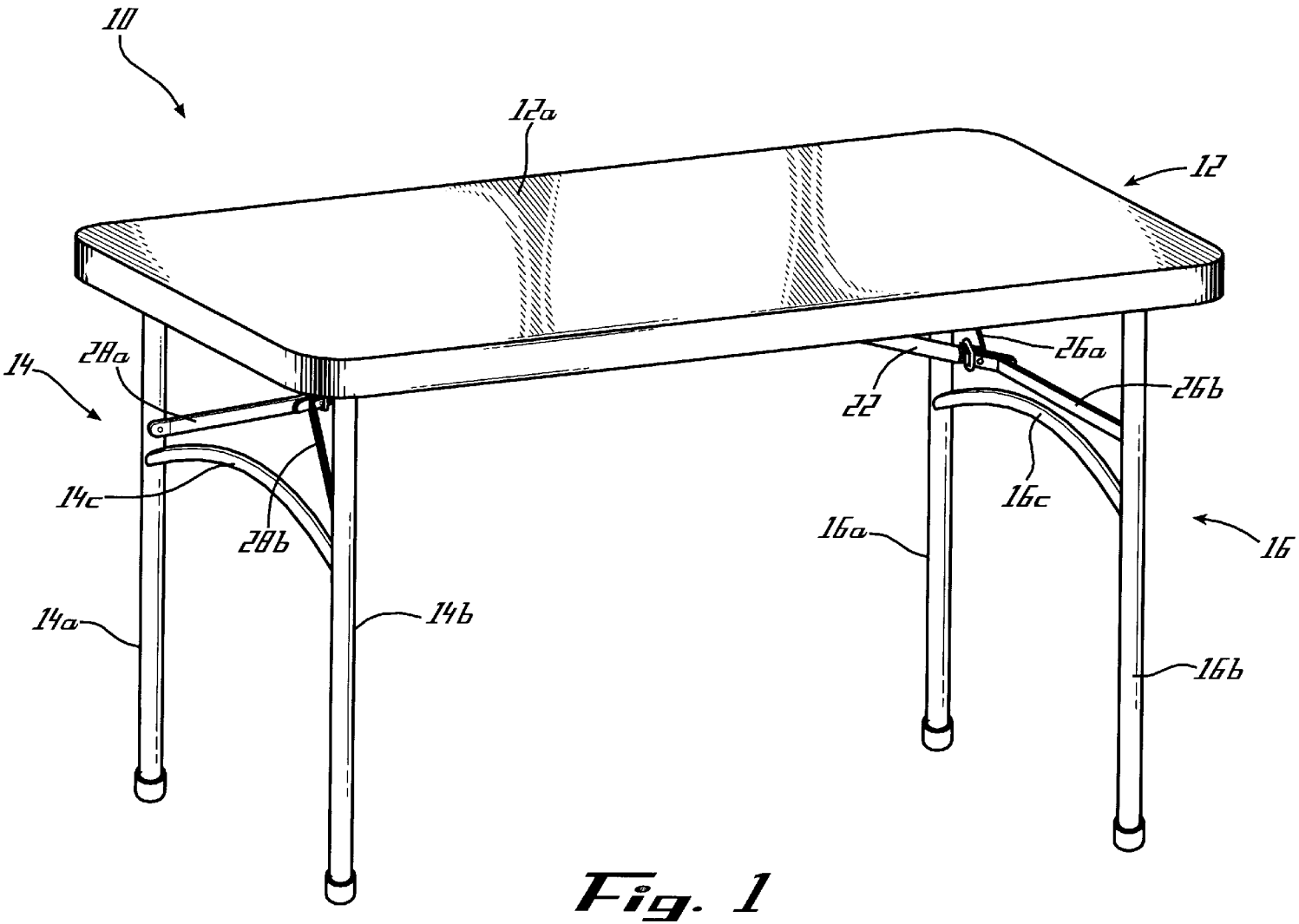
FIG. 1 is a perspective view of the top of a collapsible table according to a preferred embodiment of the invention.
Figure 2:
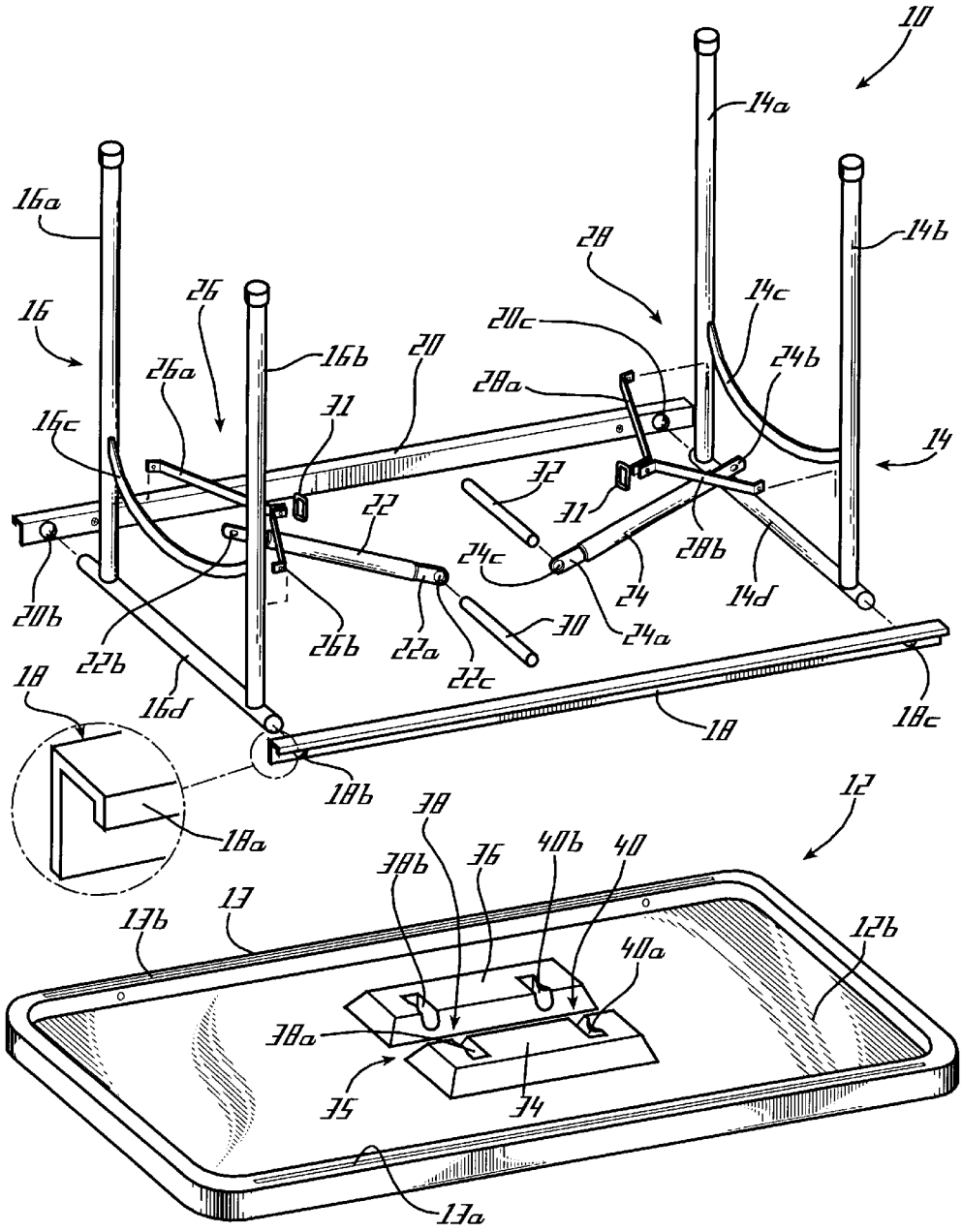
FIG. 2 is an exploded view of a collapsible table according to a preferred embodiment of the invention.
Figure 3:
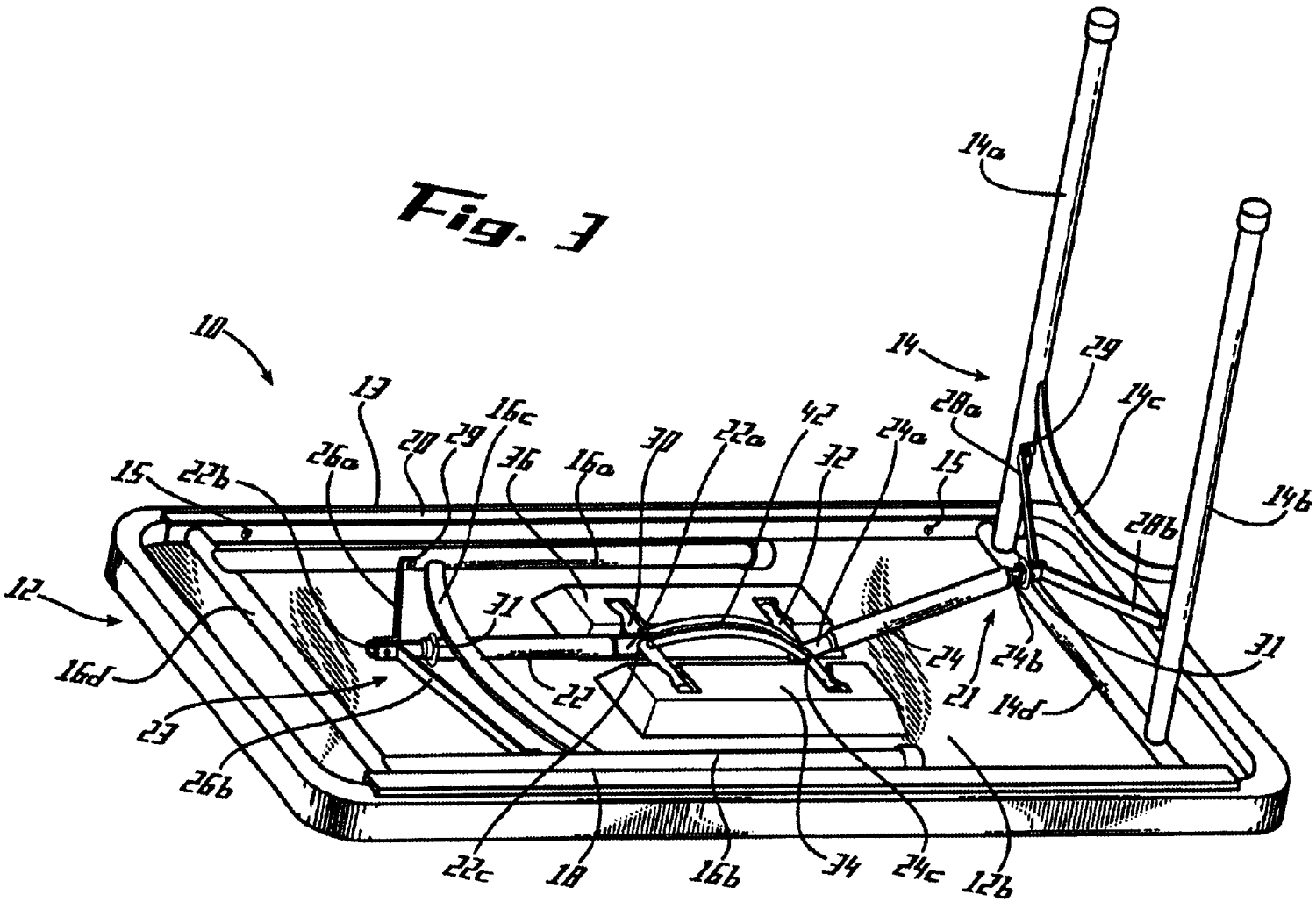
FIG. 3 is a perspective view of the bottom of a collapsible table according to a preferred embodiment of the invention.

Although the table top 12 depicted in FIGS. 1–3 is rectangular, it should be appreciated that the structures described herein are applicable to table tops that are circular, elliptical, or any other shape. Thus, the scope of the invention is not limited to any particular shape of the table top 12.

As depicted in FIGS. 2 and 3 the preferred embodiment of the table top 12 includes a peripheral lip 13 extending outward from the bottom surface 12*b*. Preferably, the lip 13 is formed during the molding of the table top 12, and is thus an integral and continuous extension of the bottom surface 12*b*. Attached to the lip 13 on opposing sides of the bottom surface 12*b* are a pair of frame members 18 and 20, also referred to herein as a first frame member 18 and a second frame member 20. Preferably, the first and second frame members 18 and 20 are secured to the lip 13 by screws 15. In the preferred embodiment, the frame members 18 and 20 are formed of metal, such as steel, and are generally L-shaped in cross-section. As depicted in FIG. 2, the frame members 18 and 20 preferably include lip portions 18*a* and 20*a* which are received in channels 13*a* and 13*b* in the lip 13 when the frame members 18 and 20 are attached to the bottom surface 12*b* of the table top 12. This interface between the lip portions 18*a*–20*a* and the channels 13*a*–13*b* tends to prevent lateral motion between the frame members 18 and 20 and the table top 12, thereby increasing the structural rigidity of the table 10.

As shown in FIG. 2, adjacent each end of the first frame member 18 are substantially circular apertures 18*a* and 18*c*, and adjacent each end of the second frame member 20 are substantially circular apertures 20*b* and 20*c*. The purpose of the apertures 18*b*–18*c* and 20*b*–20*c* is described below.

As depicted in FIGS. 1–3, the table 10 includes a pair of opposing leg assemblies 14 and 16, also referred to herein as a first leg assembly 14 and a second leg assembly 16. The first and second leg assemblies 14 and 16 are pivotally attached to and between the first and second frame members 18 and 20. In the preferred embodiment, the first leg assembly 14 comprises a pair legs 14*a* and 14*b*, each attached at one end to a cross member 14*d*. The second leg assembly 16 preferably comprises a pair legs 16*a* and 16*b*, each attached at one end to a cross member 16*d*. To provide lateral support, a brace 14*c* is provided between the legs 14*a* and 14*b*, and a brace 16*c* is provided between the legs 16*a* and 16*b*. In the preferred embodiment, the legs 14*a*–14*b* and 16*a*–16*b*, the cross members 14*d* and 16*d*, and the braces 14*c* and 16*c* are formed of metal, such as steel. However, it will be appreciated that other materials could be used, such as wood or composite materials. The attachment of the legs 14*a*–14*b* and 16*a*–16*b* to the cross members 14*d* and 16*d*, and the braces 14*c* and 16*c* to the legs 14*a*–14*b* and 16*a*–16*c*, is preferably accomplished by welding.

As shown in FIGS. 2 and 3, opposing ends of the cross member 14*d* penetrate the apertures 18*c* and 20*c* in the opposing frame members 18 and 20. Similarly, opposing ends of the cross member 16d penetrate the apertures 18*a* and 20*b* in the frame members 18 and 20. The diameters of the apertures 18*b*–18*c* and 20*b*–20*c* are preferably large enough to allow free rotation of the ends of the cross members 16*d* and 14*d* therein. In this manner, the leg assemblies 14 and 16 may be rotated between a use position and a storage position. In FIG. 3, the leg assembly 14 is depicted in the use position, and the leg assembly 16 is depicted in the storage position.

To maintain the first and second leg assemblies 14 and 16 in the use position, the table 10 includes first and second support assemblies 21 and 23. As depicted in FIGS. 2 and 3, the first support assembly 21 includes a first brace structure 28 and a first support bar 24, and the second support assembly 23 includes a second brace structure 26 and a second support bar 22. In the preferred embodiment of the invention, the first brace structure 28 comprises two opposing brackets 28*a* and 28*b*, and the second brace structure 26 comprises two opposing brackets 26*a* and 26*b*. Preferably, the bracket 28*a* is pivotally attached at one end to the leg 14*a* of the leg assembly 14 and at the other end to the second end 24*b* of the support bar 24. The bracket 28*a* is pivotally attached at one end to the leg 14*b* and at the other end to the second end 24*b* of the support bar 24. Similarly, the bracket 26*a* is pivotally attached at one end to the leg 16*a* of the leg assembly 16 and at the other end to the second end 22*b* of the support bar 22. The bracket 26*b* is pivotally attached at one end to the leg 16*b* and at the other end to the second end 22*b* of the support bar 22. The pivotal attachment of the brackets 28*a*–*b* and 26*a*–*b* to the leg assemblies 14 and 16 is preferably accomplished using bolts 29, and pivotal attachment of the brackets 28*a*–*b* and 26*a*–*b* to the support bars 24 and 22 is preferably accomplished using bolts 27. In the preferred embodiment, the brackets 28*a*–28*a* and 26*a*–26*b* are formed of steel bar stock. The first and second support bars 24 and 22 are preferably formed of tubular steel which has been pressed flat at the ends 24*a*–24*b* and 22*a*–22*b*. The first ends 24*a*–22*a* of the first and second support bars 24 and 22 are pivotally coupled to the bottom surface 12*b* of the table top 12 in a manner described hereinafter. As depicted in FIG. 2, extending outward from the bottom surface 12*b* of the table top 12 are a pair of opposing elongate projections 34 and 36, also referred to herein as first and second projections 34 and 36, which are separated by a gap 35. In the preferred embodiment, the projections 34 and 36 are formed during the molding of the table top 12, and are thus integral and continuous extensions of the material which forms the bottom surface 12*b* of the table top 12. Within the first and second projections 34 and 36 are first and second channels 38 and 40. Preferably, the first channel 38 includes a first channel portion 38*a* formed in the first projection 34, and a second channel portion 38*a* formed in the second projection 36, where the first channel portion 38*a* is aligned with the second channel portion 38b. The second channel 40 includes a third channel portion 40*a* formed in the first projection 34, and a fourth channel portion 40*b* formed in the second projection 36, where the third channel portion 40*a* is aligned with the fourth channel portion 40*b*. Preferably, the channel portions 38*a–b* and 40*a–b* take the form of cylindrical grooves molded into the first and second projections 34 and 36.

In alternative embodiments, the channels 38 and 40 are formed completely within a single projection extending from the bottom surface 12*b* of the table top 12, or are formed directly in the bottom surface 12*b*.

Figure 4:
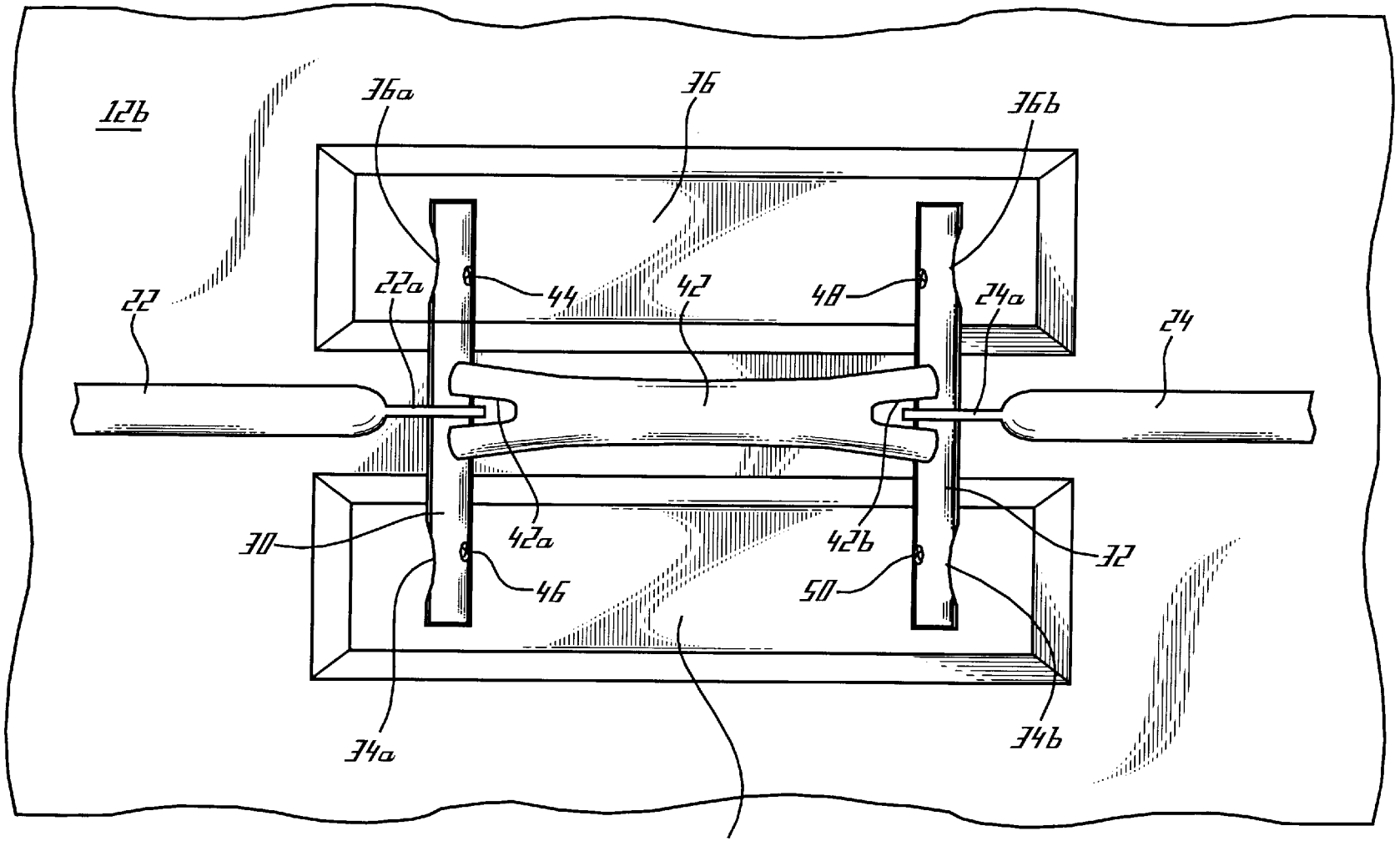
FIG. 4 depicts a structure for pivotally attaching support bars to a bottom surface of a table top of a collapsible table according to a preferred embodiment of the invention.

As depicted in FIGS. 2, 3, and 4, the preferred embodiment of the table 10 includes a pair of pivot bars 30 and 32 which are preferably formed of tubular steel. The pivot bars 30 and 32 have an outer diameter which is substantially the same as, or preferably slightly less than, the inner diameter of apertures 22*c* and 24*c* in the first ends 22*a* and 24*a* of the first and second support bars 22 and 24. As shown in FIGS. 3 and 4, the pivot bar 30 penetrates the aperture 22*c* in the first support bar 22, and the pivot bar 32 penetrates the aperture 24*c* in the second support bar 24. Thus, the first and second support bars 22 and 24 are free to pivot about the first and second pivot bars 30 and 32, respectively, as the leg assemblies 14 and 16 rotate between the use and storage positions.

The outer diameter of the first and second pivot bars 30 and 32 is also substantially the same as, or slightly less than, the inner diameter of the first and second channels 38 and 40. In this manner, the first pivot bar 30 may be inserted into the first and second channel portions 38*a–b* of the first channel 38, and the second pivot bar 32 may be inserted into the third and fourth channel portions 40*a–b* of the second channel 40. Preferably, as depicted, the channel portions 38*a–b* and 40*a–b* are blind channels, that is, they do not extend completely through the projections 34 and 36. Thus, when the first and second pivot bars 30 and 32 are inserted into the channel portions 38*a–b* and 40*a–b*, the bars 30 and 32 are preferably captured in the axial direction, thereby preventing movement of the bars 30 and 32 in the axial direction. As shown in FIG. 4, the projection 34 preferably includes lips 34*a–b* which partially overhang the first and third channel portions 38*a* and 40*a*, respectively. Similarly, the projection 36 preferably includes lips 36*a–b* which partially overhang the second and fourth channel portions 38*a* and 40*b*, respectively. The lips 34*a–b* and 36*a–b* serve to capture the pivot bars 30 and 32 so that they snap into place when inserted into the channel portions 38*a–b* and 40*a–b*. As shown in FIGS. 3 and 4, the pivot bars 30 and 32 are preferably secured in the channel portions 38*a–b* and 40*a–b* by fasteners, such as screws 44, 46, 48, and 50.

As depicted in FIG. 3, the pivotal motion of the first ends of the support bars 22 and 24 with respect to the pivot bars 30 and 32, and the pivotal motion of the brace structures 26 and 28 with respect to the support bars 22 and 24 and the leg assemblies 14 and 16, allows these structures to fold down substantially parallel to the table top 12. The gap 35 between the first and second projections 34 and 36 provides a space to accommodate the support bars 22 and 24 when the leg assemblies 14 and 16 are folded down into the storage position.

With reference to FIG. 3, the preferred embodiment of the invention includes lock rings 31, each having sufficient inner diameter to slide down over the second ends of the support bars 22*b* and 24*b* and over the attached ends of the brace structures 28 and 26 when the leg assemblies 14 and 16 are in the use position. The lock rings 31 serve to prevent the brace structures 26 and 28 from pivoting in relation to the support bars 22 and 24 when in the use position, thereby preventing an inadvertent collapse of the table 10.

As shown in FIG. 4, the preferred embodiment of the invention includes a handle 42 secured between and perpendicular to the pivot bars 30 and 32. In the preferred embodiment, the handle 42 is formed of tubular steel, and is secured at each end to the pivot bars 30 and 32 by welding. However, one skilled in the art will appreciate that the handle 42 could be attached to the pivot bars 30 and 32 by other means, such as using screws or other fasteners. Preferably, the handle has notches 42*a* and 42*b* at each end which straddle the ends 22*a* and 24*a* of the support bars 22 and 24. In this manner, the ends 22*a* and 24*a* of the support bars 22 and 24 are captured within the notches 42*a* and 42*b* to prevent lateral movement of the support bars 22 and 24 with respect to the pivot bars 30 and 32.

Figure 5:
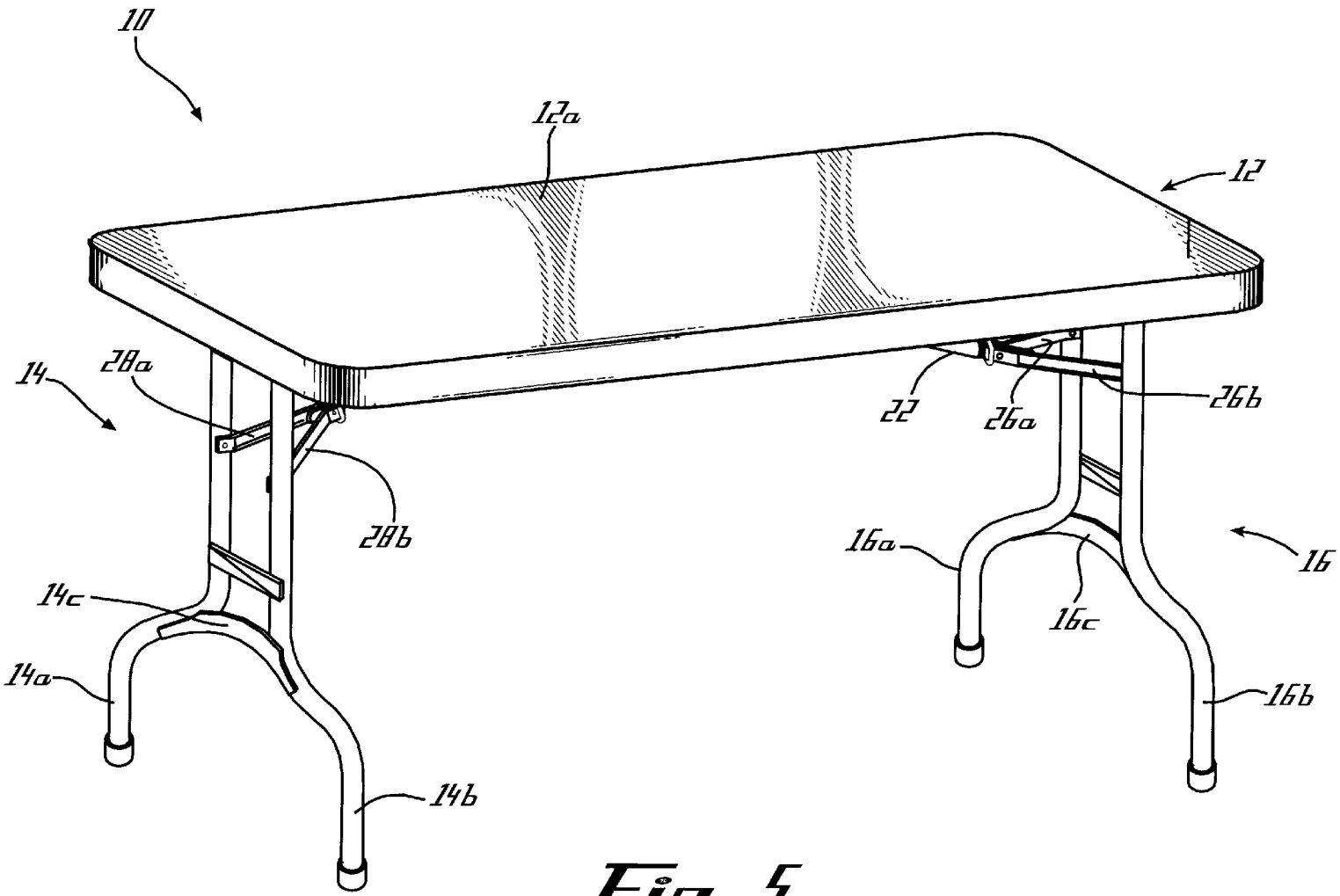
FIG. 5 is a perspective view of the top of a collapsible table according to an alternative embodiment of the invention.
Figure 6:
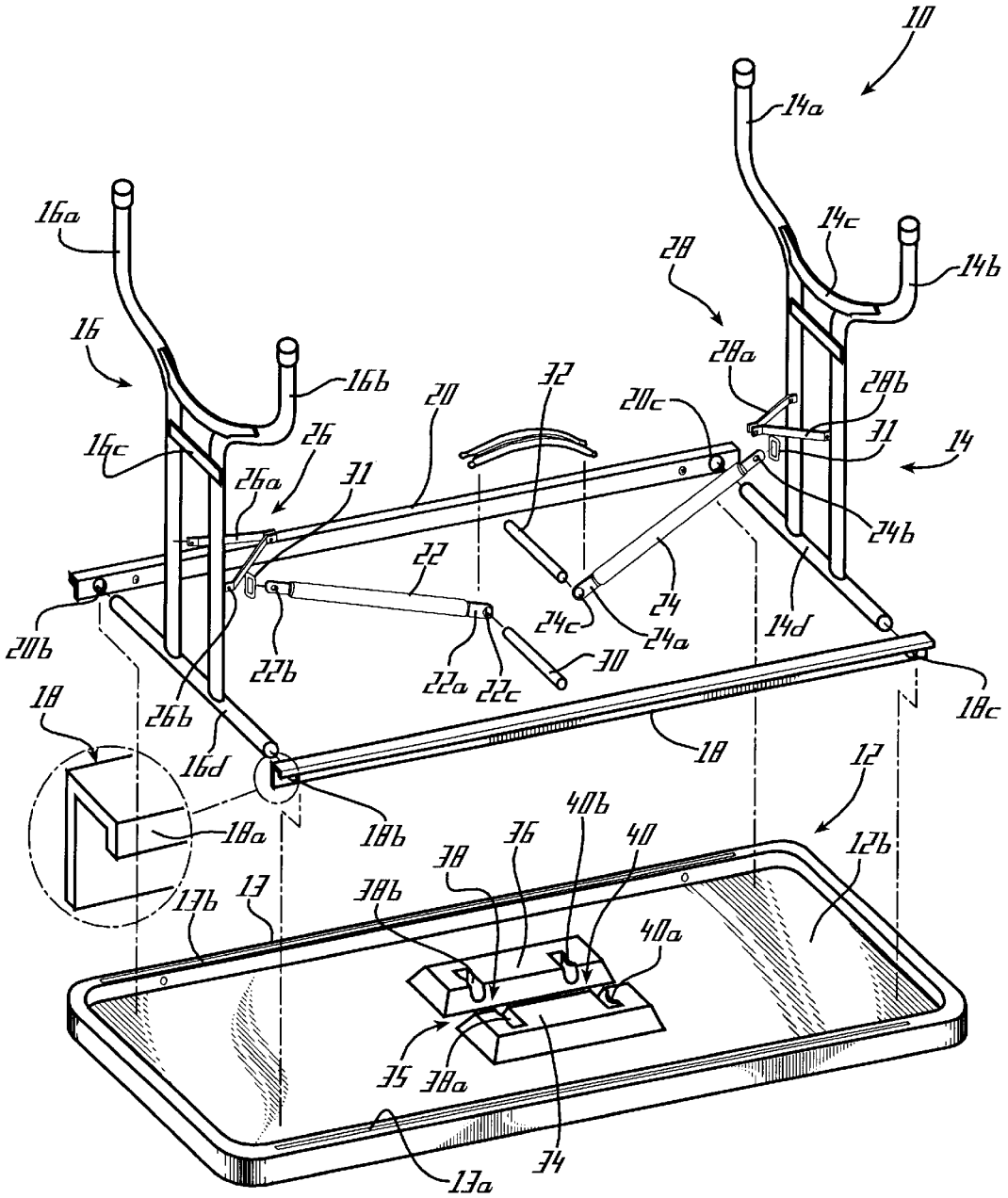
FIG. 6 is an exploded view of a collapsible table according to an alternative embodiment of the invention.
Figure 7:
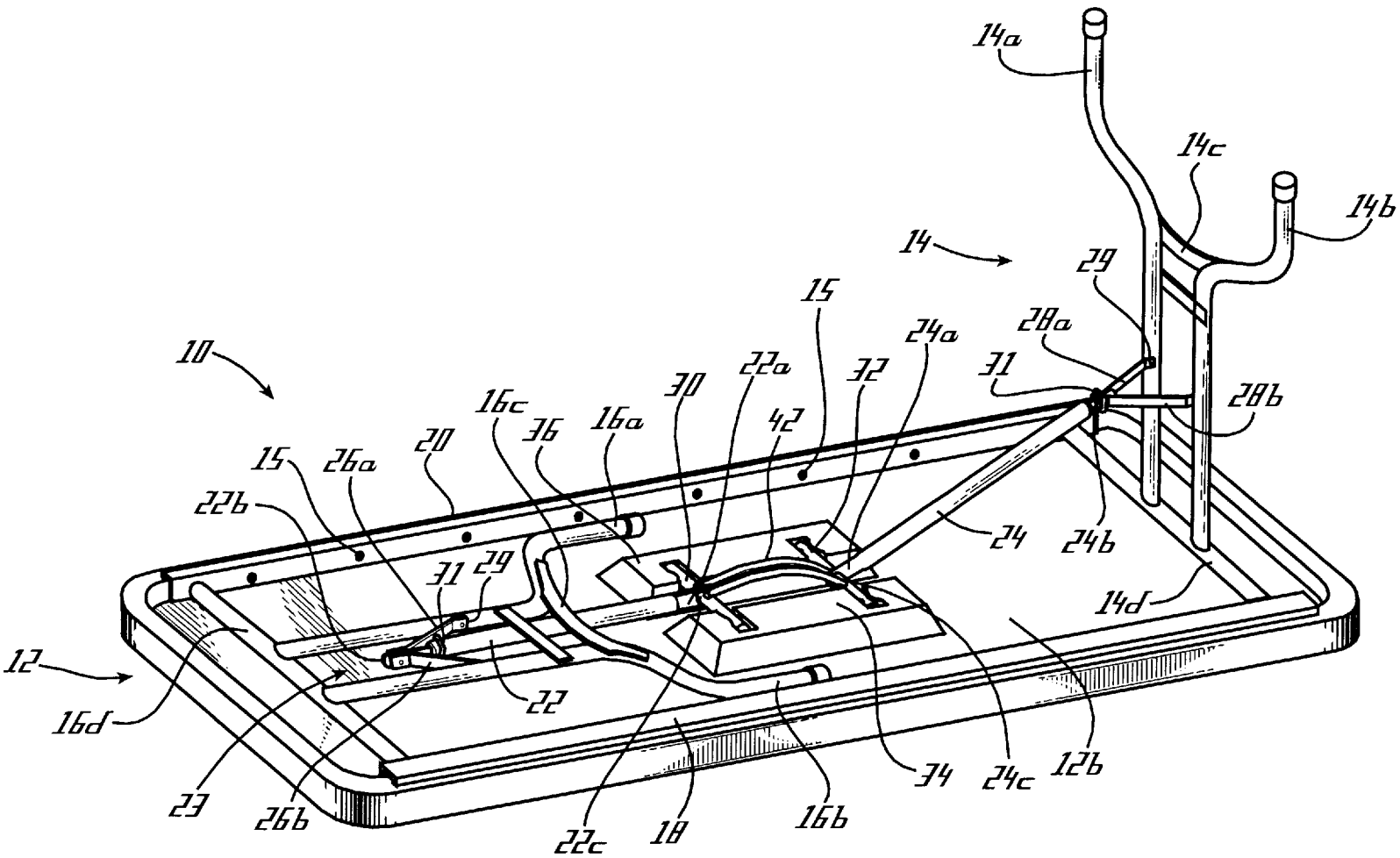
FIG. 7 is a perspective view of the bottom of a collapsible table according to an alternative embodiment of the invention.

An alternative embodiment of the table 10 is depicted in FIGS. 5–7. Except for the shape of the leg assemblies 14 and 16, the structure of this embodiment is substantially the same as the structure of the first embodiment described above. The embodiment of FIGS. 5–7 is particularly well suited for a table having a higher length-to-width ratio, such as a banquet table. For example, the table top 12 depicted in FIGS. 5–7 is preferably about 72 inches long and about 30 inches wide.

Depicted in FIGS. 8 and 9A–C is a structure for pivotally attaching the first and second support bars 22 and 24 to the bottom surface 12*b* according to an alternative embodiment of the invention. This embodiment includes four attachment brackets 102, 104, 106, and 108 attached to the bottom surface 12*b* and to the frame members 18 and 20.

Figure 8:
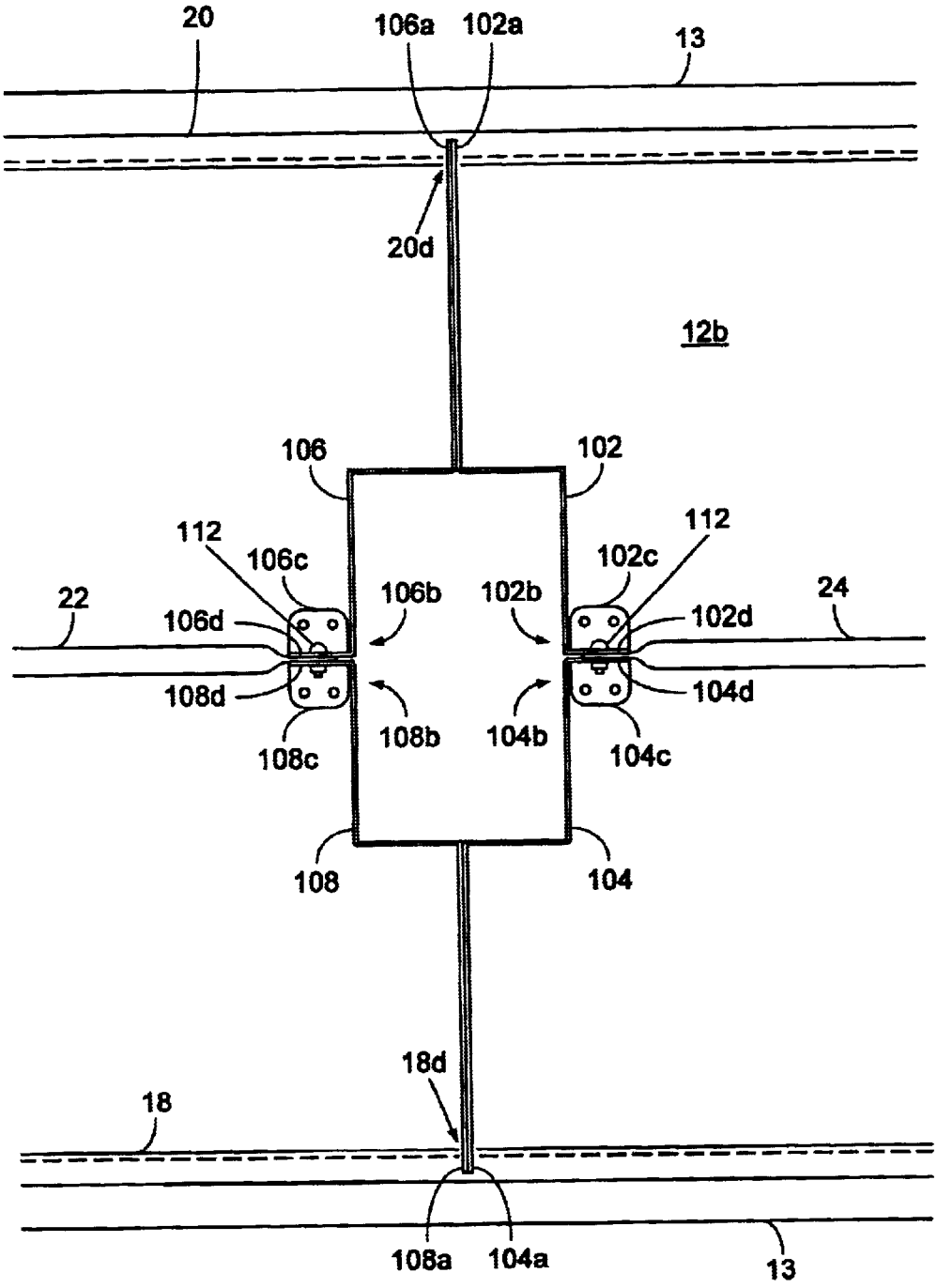
FIG. 8 depicts a structure for pivotally attaching support bars to a bottom surface of a table top of a collapsible table according to an alternative embodiment of the invention.

As shown in FIG. 8, two of the brackets 102 and 106 span one half of the bottom surface 12*b*, and the other two brackets 104 and 108 span the other half of the bottom surface 12*b*. Distal ends 102*a* and 106*a* of the brackets 102 and 106 penetrate a slot 20*d* in the frame member 20, and distal ends 104*a* and 108*a* of the brackets 104 and 108 penetrate a slot 18*d* in the opposing frame member 18. Proximate ends 102*b*, 104*b*, 106*b*, and 108*a* of the brackets 102, 10 104, 106, and 108 are secured to the bottom surface 12*b*, preferably using fasteners such as screws which pass through holes in attachment tabs 102*c*, 104*c*, 106*c*, and 108*c* and into the material of the bottom surface 12*b*.

Figure 9A:
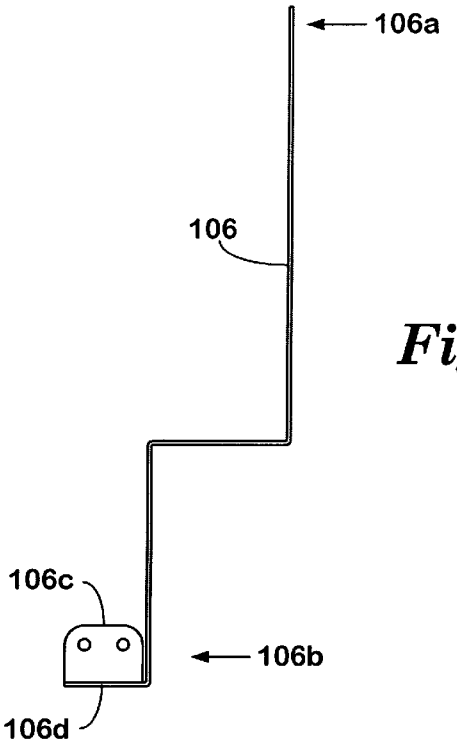
FIGS. 9A–C depict orthogonal views of an attachment bar used to pivotally attach a support bar to a bottom surface of a table top of a collapsible table according to an alternative embodiment of the invention.
Figure 9C:
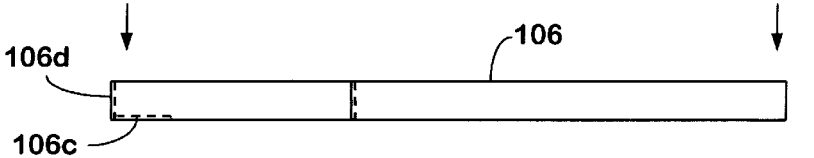
Figure 9B:
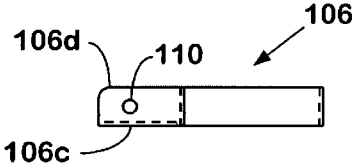

FIGS. 9A, 9B, and 9C depict three orthogonal views of the attachment bracket 106. One skilled in the art will appreciate that the bracket 102 is a horizontal mirror image of the bracket 106, and the brackets 108 and 104 are vertical mirror images of the brackets 106 and 102, respectively. As shown in FIGS. 9A, 9B, and 9C, the bracket 106 has a pivot tab 106*d* with a through-hole 110 therein. When the brackets 106 and 108 are attached to the bottom surface 12*b*, the hole 110 in the pivot tab 106*d* is aligned with an opposing hole in the pivot tab 108*d* of the bracket 108. Similarly, when the brackets 102 and 104 are attached to the bottom surface 12*b*, a hole in the pivot tab 102*d* is aligned with an opposing hole in the pivot tab 104*d* of the bracket 104. The first end 22*a* of the support bar 22 is disposed between the pivot tabs 106*d* and 108*d*, with the aperture 22*c* (FIG. 2) aligned with the holes 110 in the pivot tabs 106*d* and 108*d*. The first end 24*a* of the support bar 24 is disposed between the pivot tabs 102*d* and 104*d*, with the aperture 24*c* (FIG. 2) aligned with the holes 110 in the pivot tabs 102*d* and 104*d*. Fasteners 112, such as bolts, penetrate the holes 110 in the pivot tabs 106*d* and 108*d* and the aperture 22*c* to pivotally attach the support bar 22 to the brackets. Similarly, fasteners 112 penetrate the holes 110 in the pivot tabs 102*d* and 104*d* and the aperture 24*c* to pivotally attach the support bar 22 to the brackets 102 and 104. Thus, as the leg assemblies 14 and 16 (FIG. 3) are moved between the use position and the storage position, the support bars 22 and 24 pivot about the fasteners 112.

Although it has been determined that brackets 102, 104, 106, 108 having the shapes as depicted in FIG. 8 provide a structurally secure means of attachment, it should be appreciated that the brackets 102, 104, 106, 108 could have other shapes. For example, instead of providing three alternating 90-degree bends as depicted in FIG. 9A, the brackets 102, 104, 106, 108 could be provided with two bends of 135 degrees, while leaving the ends of the brackets at the same relative positions. In that example, the brackets 102, 104, 106, 108 would come together in a substantially diamond-shaped arrangement, rather than the rectangular arrangement depicted in FIG. 8. Thus, the scope of the invention is not limited to any particular shape of the attachment brackets 102, 104, 106, and 108.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A collapsible table comprising:

a table top having:

a substantially planar top surface;

a bottom surface opposite the top surface; and opposing first and second channels formed into the bottom surface;

a first pivot bar disposed within the first channel;

a second pivot bar disposed within the second channel;

opposing first and second frame members secured to the bottom surface of the table top;

opposing first and second leg assemblies disposed between and pivotally attached to the first and second frame members, the first and second leg assemblies movable between a use position and a storage position;

a first support assembly for maintaining the first leg assembly in the use position, the first support assembly comprising:

a first brace structure having a first central pivotal attachment point and at least one first distal pivotal attachment point, the at least one first distal pivotal attachment point pivotally attached to the first leg assembly; and a first support bar having first and second ends, the second end of the first support bar pivotally attached to the first central pivotal attachment point of the first brace structure, and the first end of the first support bar pivotally attached to the first pivot bar; and a second support assembly for maintaining the second leg assembly in the use position, the second support assembly comprising:

a second brace structure having a second central pivotal attachment point and at least one second distal pivotal attachment point, the at least one second distal pivotal attachment point pivotally attached to the second leg assembly; and a second support bar having first and second ends, the second end of the second support bar pivotally attached to the second central pivotal attachment point of the second brace structure, and the first end of the second support bar pivotally attached to the second pivot bar.

2. The collapsible table of claim 1 further comprising:

the first and second pivot bars comprising substantially cylindrical rods, each having an outside diameter; and the first and second channels each having a channel surface with an inside diameter substantially equivalent to the outside diameter of the first and second pivot bars.

3. The collapsible table of claim 2 further comprising:

the first pivot bar secured in the first channel by at least one screw passing through the first pivot bar and into the inner surface of the first channel; and the second pivot bar secured in the second channel by at least one screw passing through the second pivot bar and into the inner surface of the second channel.

4. The collapsible table of claim 1 further comprising:

the bottom surface of the table top further having opposing first and second projections separated by a separation distance;

the first channel further having a first channel portion formed in the first projection, and a second channel portion formed in the second projection opposite the first channel portion; and the first pivot bar disposed within the first and second channel portions of the first channel, and spanning the separation distance between the first and second projections.

5. The collapsible table of claim 4 further comprising:

the second channel having a third channel portion formed in the first projection, and a fourth channel portion formed in the second projection opposite the third channel portion; and the second pivot bar disposed within the third and fourth channel portions of the second channel, and spanning the separation distance between the first and second projections.

6. The collapsible table of claim 1 further comprising:

the first end of the first support bar having a first aperture with a first diameter sufficient to receive the first pivot bar;

the first pivot bar penetrating the first aperture in the first support bar;

the first end of the second support bar having a second aperture with a second diameter sufficient to receive the second pivot bar; and the second pivot bar penetrating the second aperture in the second support bar.

7. The collapsible table of claim 1 further comprising:

the first pivot bar disposed substantially in parallel with the second pivot bar, and separated from the second pivot bar by a separation distance; and a handle member having a first handle end secured to the first pivot bar and a second handle end secured to the second pivot bar, the handle member disposed substantially perpendicular to the first and second pivot bars and spanning the separation distance between the first and second pivot bars.

8. The collapsible table of claim 7 further comprising:

the first handle end of the handle member having a first notch straddling the first end of the first support bar; and the second handle end of the handle member having a second notch straddling the first end of the second support bar.

9. The collapsible table of claim 1 wherein the table top further comprises a blow-molded thermoplastic material.

10. A collapsible table comprising:

a molded table top having:

a substantially planar top surface;

a bottom surface opposite the top surface, the bottom surface having opposing first and second molded projections separated by a separation distance;

a first channel comprising a first channel portion formed in the first molded projection, and a second channel portion formed in the second molded projection opposite the first channel portion, the first and second channel portions having a first inside diameter;

a second channel comprising a third channel portion formed in the first molded projection, and a fourth channel portion formed in the second molded projection opposite the third channel portion, the third and fourth channels having a second inside diameter;

a first pivot bar disposed within the first and second channel portions of the first channel and spanning the separation distance between the first and second projections, the first pivot bar comprising a substantially cylindrical rod having a first outside diameter that is substantially equivalent to the first inside diameter of the first and second channel portions;

a second pivot bar disposed within the third and fourth channel portions of the second channel and spanning the separation distance between the first and second projections, the second pivot bar comprising a substantially cylindrical rod having a second outside diameter that is substantially equivalent to the second inside diameter of the third and fourth channel portions;

opposing first and second frame members secured to the bottom surface of the table top;

opposing first and second leg assemblies disposed between and pivotally attached to the first and second frame members, the first and second leg assemblies movable between a use position and a storage position;

a first support assembly for maintaining the first leg assembly in the use position, the first support assembly comprising:

a first brace structure having a first central pivotal attachment point and at least one first distal pivotal attachment point, the at least one first distal pivotal attachment point pivotally attached to the first leg assembly; and a first support bar having first and second ends, the second end of the first support bar pivotally attached to the first central pivotal attachment point of the first brace structure, and the first end of the first support bar pivotally attached to the first pivot bar; and a second support assembly for maintaining the second leg assembly in the use position, the second support assembly comprising:

a second brace structure having a second central pivotal attachment point and at least one second distal pivotal attachment point, the at least one second distal pivotal attachment point pivotally attached to the second leg assembly; and a second support bar having first and second ends, the second end of the second support bar pivotally attached to the second central pivotal attachment point of the second brace structure, and the first end of the second support bar pivotally attached to the second pivot bar.

11. The collapsible table of claim 10 further comprising:

the first end of the first support bar having a first aperture with a first diameter sufficient to receive the first pivot bar;

the first pivot bar penetrating the first aperture in the first support bar;

the first end of the second support bar having a second aperture with a second diameter sufficient to receive the second pivot bar; and the second pivot bar penetrating the second aperture in the second support bar.

12. The collapsible table of claim 10 further comprising:

the first pivot bar disposed substantially in parallel with the second pivot bar, and separated from the second pivot bar by a separation distance; and a handle member having a first handle end secured to the first pivot bar and a second handle end secured to the second pivot bar, the handle member disposed substantially perpendicular to the first and second pivot bars and spanning the separation distance between the first and second pivot bars.

13. The collapsible table of claim 12 further comprising:

the first handle end of the handle member having a first notch straddling the second end of the first support bar; and the second handle end of the handle member having a second notch straddling the second end of the second support bar.

14. In a collapsible table of a type having a molded table top with a substantially planar top surface and a bottom surface opposite the top surface, opposing first and second frame members secured to the bottom surface of the table top, opposing first and second leg assemblies disposed between and pivotally attached to the first and second frame members, where the first and second leg assemblies are movable between a use position and a storage position, a first support assembly for maintaining the first leg assembly in the use position, where the first support assembly includes a first brace structure having a first central pivotal attachment point and a first distal pivotal attachment point, where the first distal pivotal attachment point is pivotally attached to the first leg assembly, and a first support bar having first and second ends, where the second end of the first support bar is pivotally attached to the first central pivotal attachment point of the first brace structure, and a second support assembly for maintaining the second leg assembly in the use position, where the second support assembly includes a second brace structure having a second central pivotal attachment point and a second distal pivotal attachment point, where the second distal pivotal attachment point is pivotally attached to the second leg assembly, and a second support bar having first and second ends, where the second end of the second support bar is pivotally attached to the second central pivotal attachment point of the second brace structure, an improvement comprising:

opposing first and second channels molded into the bottom surface of the table top;

a first pivot bar disposed within the first channel;

the second end of the first support bar pivotally attached to the first pivot bar;

a second pivot bar disposed within the second channel; and the second end of the second support bar pivotally attached to the second pivot bar.

15. The improvement of claim 14 wherein:

the first and second pivot bars comprise substantially cylindrical rods, each having an outside diameter; and the first and second channels each have a channel surface with an inside diameter substantially equivalent to the outside diameter of the first and second pivot bars.

16. The improvement of claim 15 wherein:

the first pivot bar is secured in the first channel by at least one screw passing through the first pivot bar and into the inner surface of the first channel; and the second pivot bar is secured in the second channel by at least one screw passing through the second pivot bar and into the inner surface of the second channel.

17. The improvement of claim 14 further comprising:

opposing first and second molded projections in the bottom surface of the table top, the first and second molded projections separated by a separation distance;

the first channel having a first channel portion formed in the first projection, and a second channel portion formed in the second projection opposite the first channel portion; and the first pivot bar disposed within the first and second channel portions of the first channel, and spanning the separation distance between the first and second projections.

18. The improvement of claim 17 further comprising:

the second channel having a third channel portion formed in the first projection, and a fourth channel portion formed in the second projection opposite the third channel portion; and the second pivot bar disposed within the third and fourth channel portions of the second channel, and spanning the separation distance between the first and second projections.

19. The improvement of claim 14 further comprising:

the first pivot bar disposed substantially in parallel with the second pivot bar, and separated from the second pivot bar by a separation distance; and a handle member having a first handle end secured to the first pivot bar and a second handle end secured to the second pivot bar, the handle member disposed substantially perpendicular to the first and second pivot bars and spanning the separation distance between the first and second pivot bars.

20. The improvement of claim 19 further comprising:

the first handle end of the handle member having a first notch straddling the first end of the first support bar; and the second handle end of the handle member having a second notch straddling the first end of the second support bar.

21. A collapsible table comprising:

a table top having:

a substantially planar top surface;

a bottom surface opposite the top surface;

opposing first and second frame members secured to the bottom surface of the table top, the first frame member having a first central slot, and the second frame member having a second central slot;

a first attachment bracket having a first distal end penetrating the first central slot of the first frame member and a first proximal end secured to the bottom surface of the table top;

a second attachment bracket having a second distal end penetrating the second central slot of the second frame member and a second proximal end secured to the bottom surface of the table top adjacent the first proximal end of the first attachment bracket;

a third attachment bracket having a third distal end penetrating the first central slot of the first frame member and a third proximal end secured to the bottom surface of the table top;

a fourth attachment bracket having a fourth distal end penetrating the second central slot of the second frame member and a fourth proximal end secured to the bottom surface of the table top adjacent the third proximal end of the third attachment bracket;

opposing first and second leg assemblies disposed between and pivotally attached to the first and second frame members, the first and second leg assemblies movable between a use position and a storage position;

a first support assembly for maintaining the first leg assembly in the use position, the first support assembly comprising:

a first brace structure having a first central pivotal attachment point and at least one first distal pivotal attachment point, the at least one first distal pivotal attachment point pivotally attached to the first leg assembly; and a first support bar having first and second ends, the second end of the first support bar pivotally attached to the first central pivotal attachment point of the first brace structure, and the first end of the first support bar disposed between and pivotally coupled to the first proximal end of the first attachment bracket and the second proximal end of the second attachment bracket; and a second support assembly for maintaining the second leg assembly in the use position, the second support assembly comprising:

a second brace structure having a second central pivotal attachment point and at least one second distal pivotal attachment point, the at least one second distal pivotal attachment point pivotally attached to the second leg assembly; and a second support bar having first and second ends, the second end of the second support bar pivotally attached to the second central pivotal attachment point of the second brace structure, and the first end of the second support bar disposed between and pivotally coupled to the third proximal end of the third attachment bracket and the fourth proximal end of the fourth attachment bracket.

22. A method for manufacturing a collapsible table comprising the steps of:

(a) forming a table top having a substantially planar top surface, a bottom surface opposite the top surface, and opposing first and second channels in the bottom surface;

(b) securing opposing first and second frame members to the bottom surface of the table top;

(c) pivotally attaching first and second leg assemblies to the first and second frame members, such that the first and second leg assemblies are movable between a use position and a storage position;

(d) providing a first brace structure having a first central pivotal attachment point and at least one first distal pivotal attachment point;

(e) pivotally attaching the first distal pivotal attachment point of the first brace structure to the first leg assembly;

(f) providing a first support bar having first and second ends;

(g) pivotally attaching the second end of the first support bar to the first central pivotal attachment point of the first brace structure;

(h) providing a first pivot bar;

(i) pivotally attaching the first end of the first support bar to the first pivot bar;

(j) inserting the first pivot bar into the first channel in the bottom surface of the table top;

(k) providing a second brace structure having a second central pivotal attachment point and at least one second distal pivotal attachment point;

(l) pivotally attaching the second distal pivotal attachment point of the second brace structure to the second leg assembly;

(m) providing a second support bar having first and second ends;

(n) pivotally attaching the second end of the second support bar to the second central pivotal attachment point of the second brace structure;

(o) providing a second pivot bar;

(p) pivotally attaching the first end of the second support bar to the second pivot bar; and (q) inserting the second pivot bar into the second channel in the bottom surface of the table top.

23. The method of claim 22 further comprising:

(r) securing the first pivot bar in the first channel by passing at least one screw through the first pivot bar and into an inner surface of the first channel; and (s) securing the second pivot bar in the second channel by passing at least one screw through the second pivot bar and into an inner surface of the second channel.

24. The method of claim 22 wherein:

step (f) further comprises providing the first support bar having a first aperture in the first end, where the first aperture has a first diameter sufficient to receive the first pivot bar;

step (i) further comprises inserting the first pivot bar through the first aperture in the first support bar;

step (m) further comprises providing the second support bar having a second aperture in the first end, where the second aperture has a second diameter sufficient to receive the second pivot bar; and step (p) further comprises inserting the second pivot bar through the second aperture in the second support bar.

25. The method of claim 22 further comprising:

(r) providing a handle member having a first handle end and a second handle end;

(s) securing the first handle end to the first pivot bar; and (t) securing the second handle end to the second pivot bar.

* * * * *